US006142598A

United States Patent [19]

Iwasaki et al.

[11] Patent Number: 6,142,598

[45] Date of Patent: Nov. 7, 2000

[54] PRINTING APPARATUS AND PRINTING METHOD

[75] Inventors: Osamu Iwasaki, Tokyo; Naoji Otsuka, Yokohama; Kentaro Yano, Yokohama; Daigoro Kanematsu, Yokohama, all of Japan

[73] Assignee: Canon Kabushiki Kaisha, Tokyo, Japan

[21] Appl. No.: 08/898,497

[22] Filed: Jul. 22, 1997

[30] Foreign Application Priority Data

Jul. 23, 1996 [JP] Japan ..... 8-193494
Jul. 11, 1997 [JP] Japan ..... 9-186366

[51] Int. Cl.[7] ..... B41J 29/38

[52] U.S. Cl. ..... 347/9

[58] Field of Search ..... 347/9, 12

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,347,300 | 9/1994 | Futagawa | 347/9 |
| 5,675,365 | 10/1997 | Becerra et al. | 347/9 |
| 5,724,077 | 3/1998 | Murata | 347/12 |
| 5,781,203 | 7/1998 | Uriu et al. | 347/9 |
| 5,844,585 | 12/1998 | Kurashima et al. | 347/9 X |
| 5,923,344 | 7/1999 | Norum et al. | 347/9 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Fred L. Braun
*Attorney, Agent, or Firm*—Fitzpatrick, Cella, Harper & Scinto

[57] ABSTRACT

In a print apparatus and method in which the print head having printing elements to form print dots is made to scan over a printing medium in a predetermined direction to form a printed image, the drive timing intervals between a plurality of dots formed in the scan direction by the same printing element are changed in a cycle smaller than a cycle in which a printed image variation appears, in order to eliminate the printed image unevenness that cyclically appears due to variations in the manufacturing errors of a rotary drive source and other mechanisms for performing the scanning. By driving the printing elements in this way, it is possible to change the distance between adjoining dots in the predetermined direction in a short cycle and thereby render the cyclic unevenness caused by the rotary drive source visually impossible to recognize.

28 Claims, 13 Drawing Sheets

PRINTING APPARATUS AND PRINTING METHOD

BACKGROUND OF THE INVENTION

1. Field of the Invention

The present invention relates to a printing apparatus and method that forms images by forming a number of dots on a printing medium and more particularly to a printing apparatus and method which can form high-quality images.

2. Description of the Related Art

Image forming devices widely used in printers, copying machines, facsimiles and recording apparatuses produce images from dot patterns on a printing medium, such as paper, plastic films and cloth, according to image information entered. Such image forming devices may be classified, according to the printing method employed, into a wire dot printing, a heat transfer printing, a heat-sensitive printing, an ink jet printing, and an electrophotographic printing. Of these printing methods, the heat transfer printing and the ink jet printing have in recent years found a wide range of applications as the image forming devices because of their ability to realize a high resolution at low cost.

In the above image forming devices, a print head 1 having a plurality of printing elements A–H that constitute an image forming unit forms dots a–h, as shown in FIG. 1. This process is repeated during a scanning (main scanning) to cause each of the printing elements A–H to form further dots (in FIG. 1, (1) to (5)).

FIG. 2 is an external perspective view showing an example of the image forming device equipped with a mechanism that performs the printing explained above. In this figure, reference numeral 20 denotes a print head having a group of ink ejecting openings or orifices as printing elements that are disposed opposite the print surface of a printing medium fed onto a platen 24 and print on the medium. Reference numeral 16 denotes a carriage that holds the print head 20. The carriage 16 is connected to a part of a drive belt 18 that transmits a driving force of a drive motor (main scan motor) 17, and is slidably supported on two parallel guide shafts 19A, 19B so that the print head 20 can reciprocally travel over the entire width of the printing medium. The print head 20 during its reciprocal movement prints an image according to received data on the printing medium. After each main scan operation is completed, the driving force of a subscan motor 22 is transmitted through a transmission mechanism 23 and a feeding mechanism to the printing medium, which is fed a predetermined distance in a subscan direction. Denoted 26 is a recovery unit 26 to maintain the ink jet print head 20 in good condition, which has a cap 26A for capping the print head 20 while the head is not in use or for accepting ink from the head for recovering its ink discharging performance during a recovery operation by ink sucking, and also a blade 31 for wiping a head surface where ink ejecting portions open.

A construction commonly used to obtain a main scan direction position of the carriage relative to the printing medium includes a linear scale provided parallel to the guide shaft and an encoder provided to the carriage to read the linear scale. A personal recording device for which low cost is most desired does not adopt the above construction but instead includes means for detecting the reference position of the carriage and uses a pulse motor in place of the drive motor, in order to detect the amount of displacement from the reference position in an open loop by checking the number of pulses applied to the pulse motor.

In the above conventional recording devices, however, manufacturing variations of a rotary drive source such as a pulse motor and of a motor driver that controls it are known to cause cyclic variations in the driving state. These in turn cause small cyclic variations in the speed of the carriage. Hence, the dot forming positions on the printing medium, where dots are formed by the print head as it is reciprocally moved by the carriage, cyclically deviate from the correct dot forming position.

FIG. 3 shows the amount of deviation of each dot from the correct dot forming position ("0" position), when data to be printed by forming dots at equal intervals in the main scan direction is printed by an image forming device that inherently produces such deviations. Dot numbers are numbers beginning with 0 that are assigned to the dots aligned in the main scan direction.

FIG. 4 shows distances between adjacent dots that are printed in a manner described above. As shown in this diagram, dots whose intervals are large gather locally in one area while those with small intervals locally concentrate in another area, with the large-interval area and the small-interval area occurring periodically, causing variations in the dot distribution. This in turn causes tonal variations or unevenness in the printed image, which are particularly noticeable when gray scale print data is printed.

SUMMARY OF THE INVENTION

It is therefore an object of the present invention to eliminate the above-mentioned tonal variations that can occur with gray scale printed images, thereby allowing high-quality images to be formed.

In a first aspect of the invention, a print apparatus for forming an image on a printing medium by scanning a print head over a printing medium in a predetermined direction, the print head having a printing element to form print dots, the apparatus comprises:

a drive means for driving the printing element to form dots; and means for changing drive timings of the printing element in a predetermined cycle during the scanning.

In a second aspect of the invention, a print apparatus for forming an image on a printing medium by scanning a print head over a printing medium in a predetermined direction, the print head having a printing element to form print dots, the apparatus comprises:

a drive means for driving the printing element to form the dots with timings when the positions of the printing element in the predetermined direction coincide with dot coordinate grids of an image to be printed; and means for switching from the dot coordinate grids of the image to dot coordinate grids whose grid intervals in the predetermined direction change in a predetermined cycle.

In a third aspect of the invention, a print method for forming an image on a printing medium comprises the steps of:

scanning a print head over the printing medium in a predetermined direction, the print head having a printing element for forming print dots;

driving the printing element during the scanning to form the dots; and changing the timing of driving the printing element in a predetermined cycle.

In a fourth aspect of the invention, a print method for forming an image on a printing medium comprises the steps of:

scanning a print head over the printing medium in a predetermined direction, the print head having a printing element for forming print dots;

driving the printing element to form the dots at timings when the positions of the printing element in the predetermined direction coincide with dot coordinate grids of an image to be printed; and switching from the dot coordinate grids used of the image to dot coordinate grids whose grid intervals in the predetermined direction change in a predetermined cycle.

In any one of the above aspects of the invention, the predetermined cycle may be set to be smaller than a cycle in which a printed image variation occurs in the predetermined direction during the scanning on condition that the drive timings are not changed.

The print head may have a plurality of the printing elements aligned in a direction different from the predetermined direction.

The print head may be in the form of an ink jet head for ejecting ink from ejecting openings to perform printing.

Here, the print head may have thermal energy generating elements for generating thermal energy to be utilized for ejecting ink from the ejecting openings.

DETAILED DESCRIPTION OF PREFERRED EMBODIMENTS

Embodiments of this invention will be described by referring to the accompanying drawings.

First Embodiment

Figure 2:
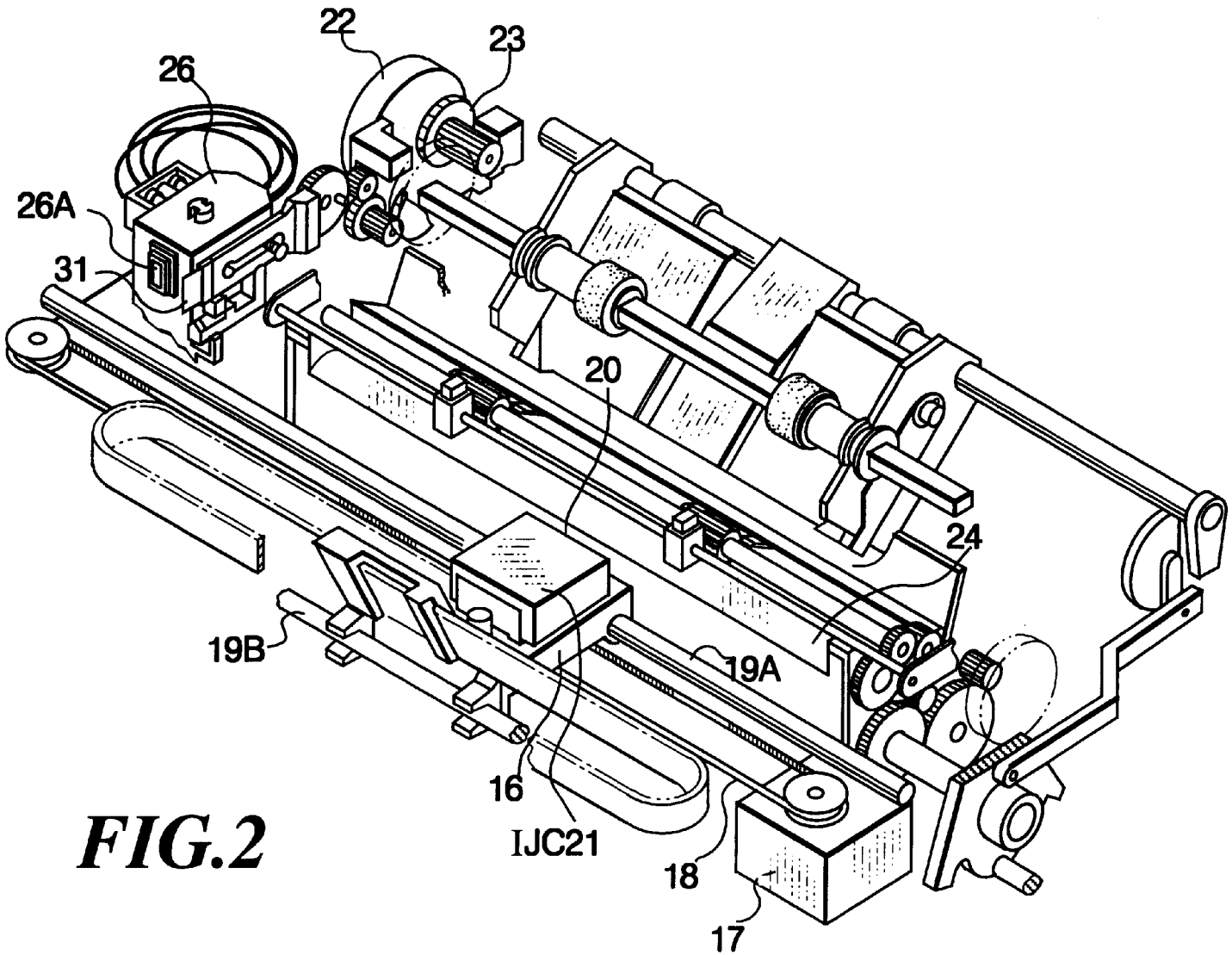
FIG. 2 is a perspective view showing an outline construction of a printer to which the present invention can be applied.

The first embodiment of this invention causes a printer such as shown in FIG. 2 to form a printed image by cyclically changing, one column at a time, drive timing intervals between dots formed in the main scan direction by the same printing element, the column being a group of dots aligned in a non-main scan direction and formed by a plurality of printing elements. By driving the printing elements in this manner, it is possible to change the distance between adjoining dots in the main scan direction in a short cycle and thereby eliminate visually noticeable cyclic unevenness caused by the drive system.

The above drive method will be explained by referring to the drawings.

Figure 5:
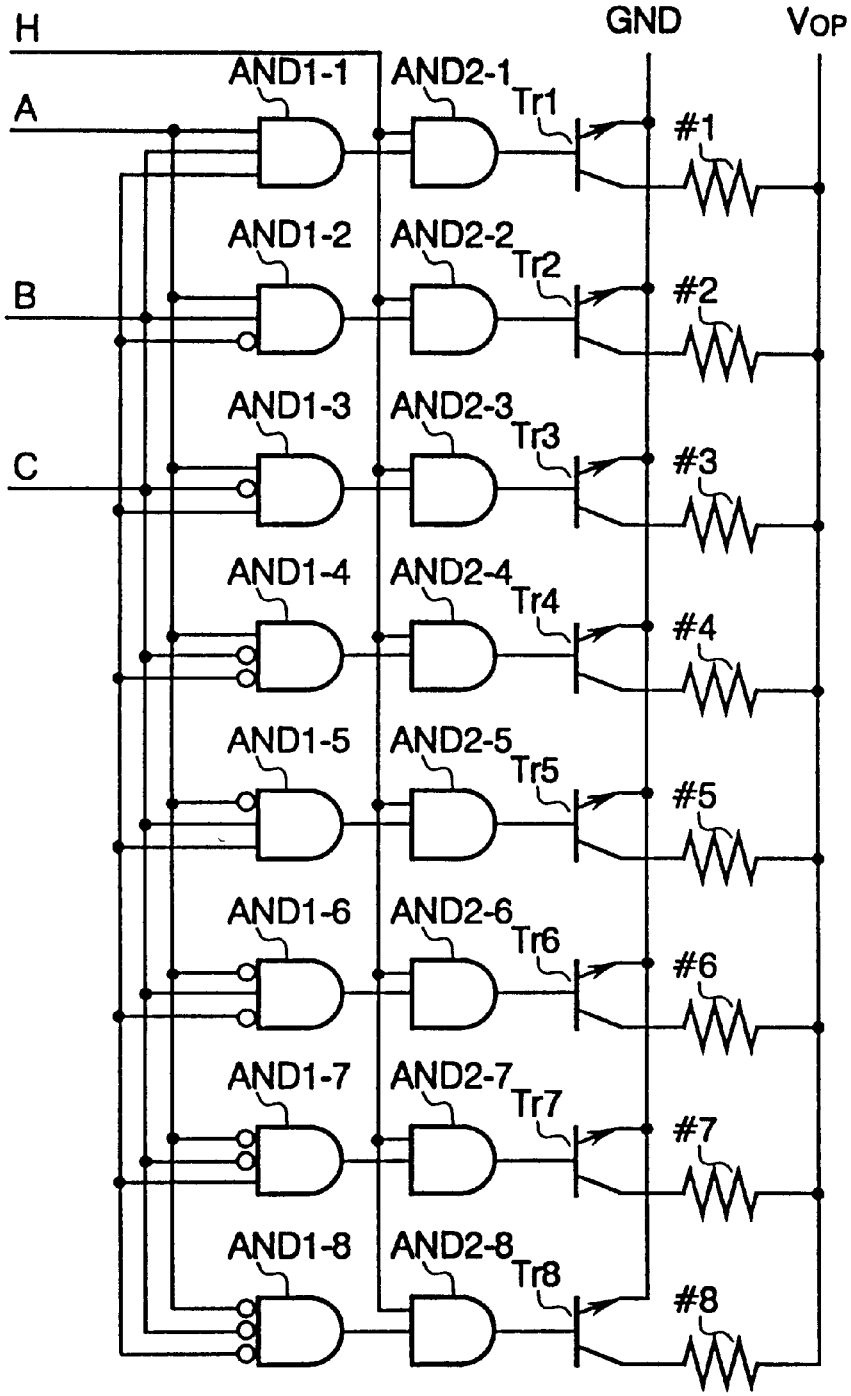
FIG. 5 is an example of a drive circuit to drive printing elements.

FIG. 5 shows an example drive circuit for driving the printing elements. Numbers 1–8 represent ejecting heaters for generating thermal energy for allowing a phenomenon of film boiling to appear in ink to eject ink from orifices. Tr1 to Tr8 denote switching transistors connected, along with the heaters #1–#8, between a power supply line and a ground line to turn on and off conduction of the heaters #1–#8.

Figure 1:
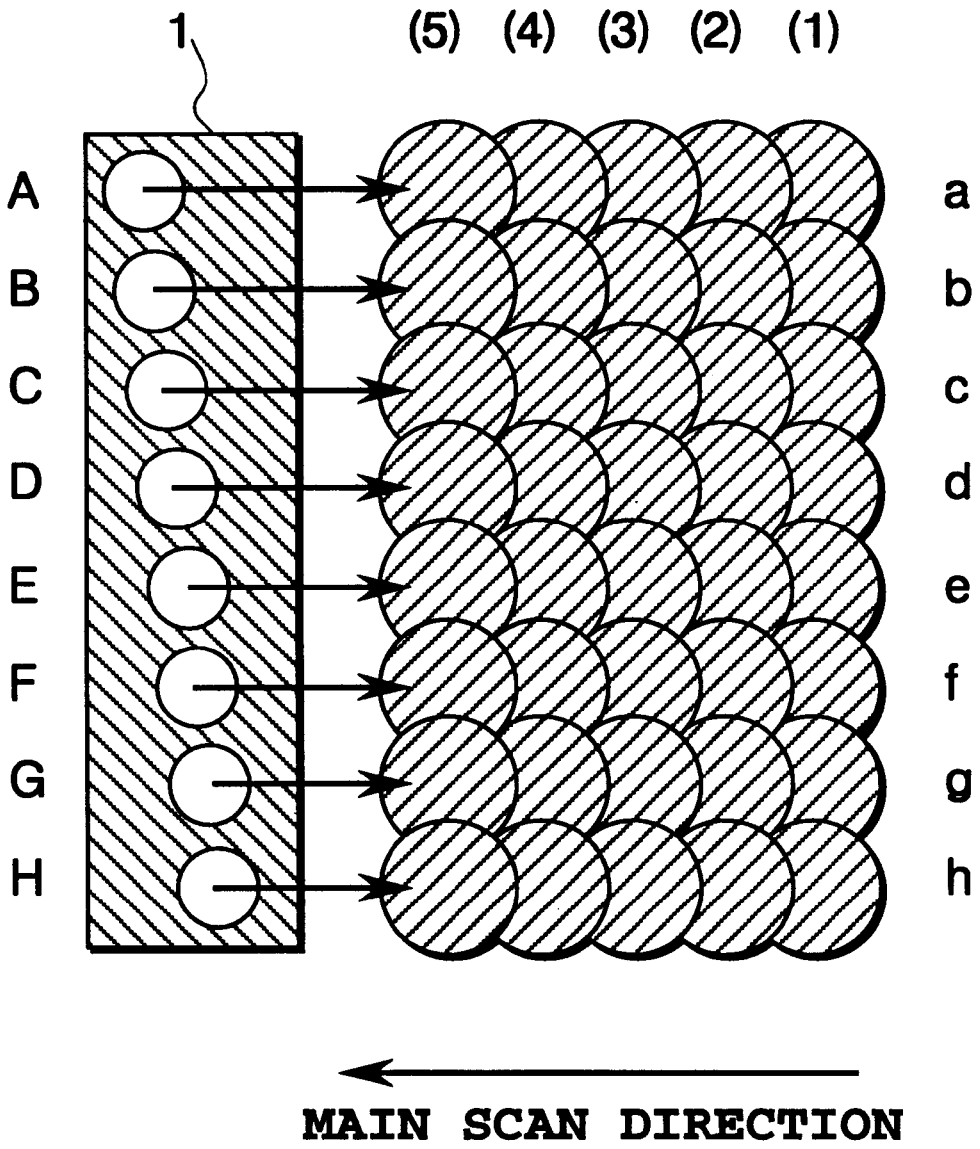
FIG. 1 shows a general print head and dots formed by the print head.
Figure 6:
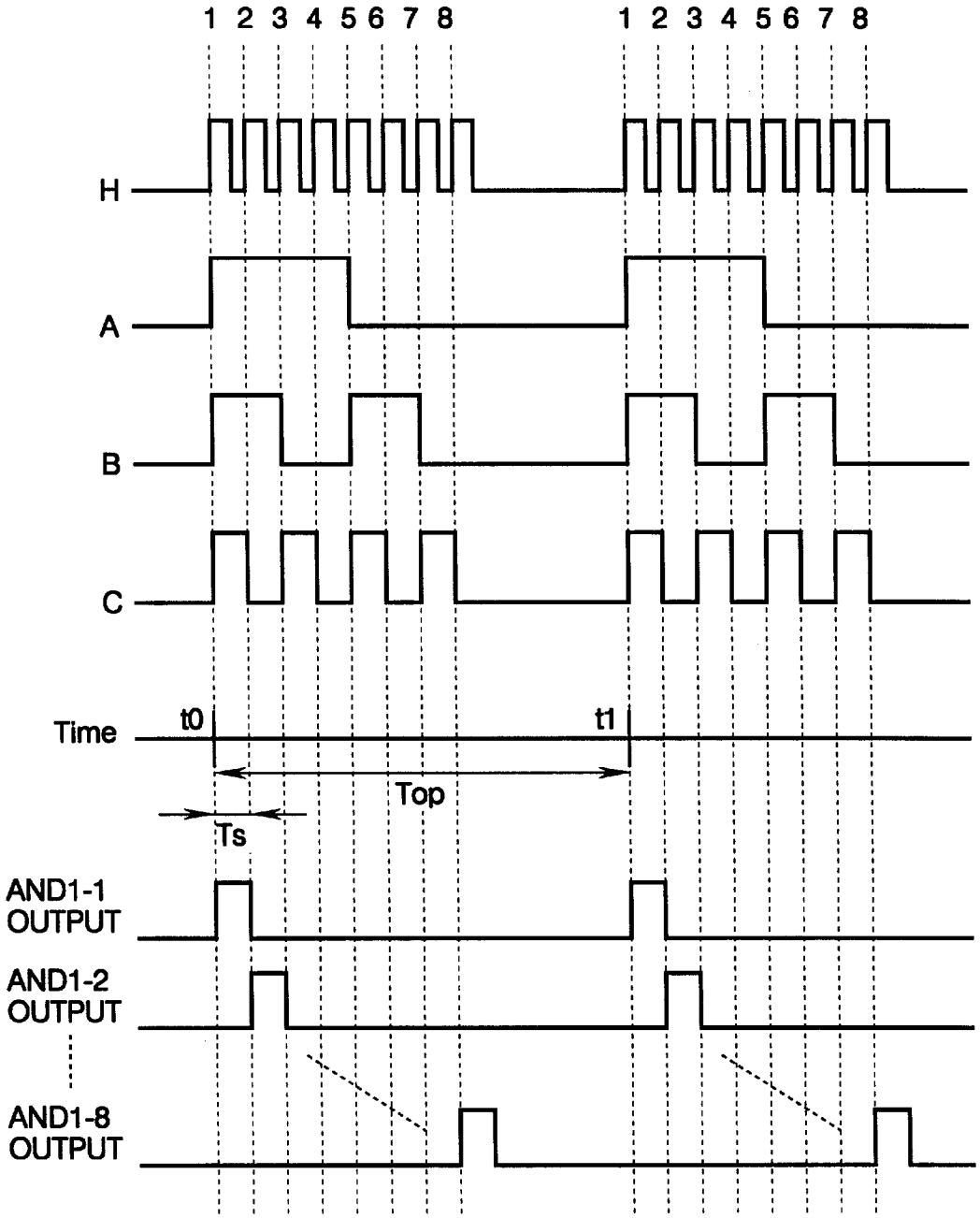
FIG. 6 is a timing chart to explain the operation of the circuit of FIG. 5.

AND gates AND1-1 to AND1-8 are provided to ensure that the ejecting of ink from ejecting openings or orifices aligned inclined with respect to the sub-scan direction, as shown in FIG. 1, is performed at appropriate timing. These 3-input AND gates AND1-1 to AND1-8 are supplied pulse signals A–C as shown in FIG. 6. The AND gates receiving these signals have their input terminals appropriately set as inverted or non-inverted terminals so as to produce pulse signal outputs at sequential timings as shown. The outputs of the AND gates AND1-1 to AND1-8 are supplied to 2-input AND gates AND2-1 to AND2-8 at one of their two input terminals. The other input terminal of each 2-input AND gate is supplied a pulse signal H representing an image. Hence, a series of pulses 1–8 corresponding to image signals turns on the heaters #1–#8 at timings determined for individual orifices, thus forming an image for one column.

Figure 7:
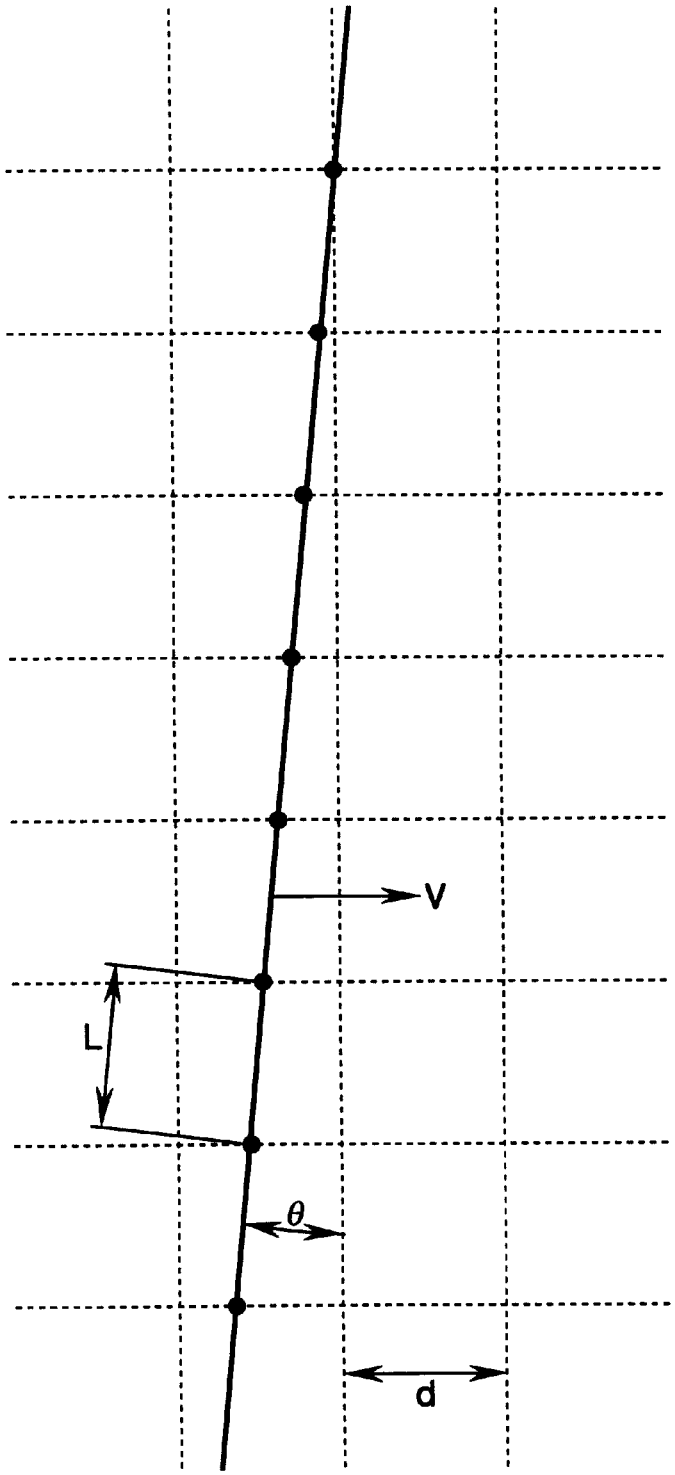
FIG. 7 shows the positional relation between a print dot coordinate system and the printing elements in the first embodiment.

FIG. 7 shows the positional relation between a image to be printed and orifices constructing the printing elements of the print head. The drive timing interval $T_s$ in FIG. 6 between adjacent printing elements is determined by a distance L between the adjacent printing elements, an inclination angle θ of the printing elements with respect to the sub-scan direction, and a velocity v of the print head in the main scan direction.

$$T_s=(L\times\sin\theta)/v \tag{1}$$

The drive timing interval for the same printing element $T_{op}$ ($T_{op}=T_1-T_0$) is determined by a pixel distance d in the print image and a velocity of the print head in the main scan direction, as follows.

$$T_{op}=d/v \tag{2}$$

As described above, when cyclic tonal variations or unevenness are produced in the drive condition by variations in manufacturing errors of a rotary drive source such as a pulse motor and of a motor driver that controls it, the carriage is cyclically accelerated and decelerated, causing small variations in the moving speed of the carriage. This in turn causes the positions on the printing medium of the dots printed by the print head on the carriage to cyclically deviate from the correct dot forming position (zero position in FIG. 4).

To eliminate visually noticeable shade level variations or unevenness caused by the cyclic variations associated with the drive system, this embodiment performs a control of shifting the drive timing of the printing elements. In this embodiment, the drive timing interval $T_s$ between the adjacent printing elements in FIG. 6 is fixed at the value mentioned above and the block drive timing $T_{op}$ is adjusted for an n-th column in the main scan direction as follows.

$$T_{op}=d/v+f(n) \quad (3)$$

where f(n) is a periodic function and $$f(n+j)=f(n) \text{ (j is a positive integer)} \quad (4)$$

The cycle or period of the drive timing for the same printing element is determined by the value of j.

Figure 8:
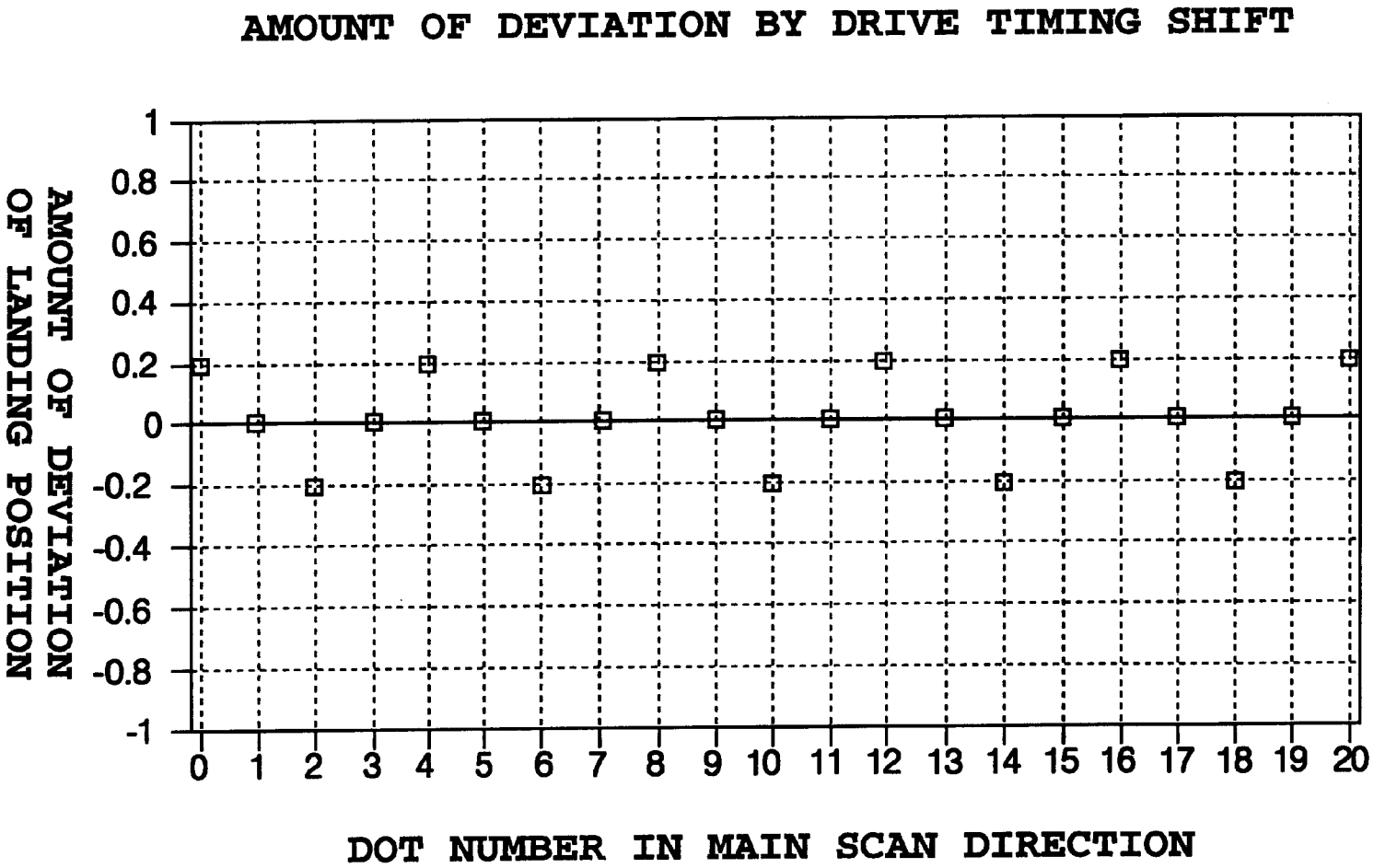
FIG. 8 shows deviations of landing positions of ink dots formed during the main scan printing which are changed at high frequency in the first embodiment.

For example, to shift the drive timing as shown in FIG. 8, i.e., to determine a drive timing that will shift the ink landing position by a predetermined distance in the main scan direction (+direction) and in the opposite direction (−direction) from the normal landing position (zero position) obtained by the normal drive timing under the condition that the carriage moving speed is constant, the following steps may be taken.

$$f(0)=1.2\times d/v$$

$$f(1)=1.0\times d/v$$

$$f(2)=0.8\times d/v$$

$$f(3)=1.0\times d/v \text{(where } f(n+4)=f(n)\text{)tm} \quad (5)$$

In this example, note that the drive timing is shifted every four dots (four columns) in the main scan direction. That is, j=4, f(n+4)=f(n).

Figure 9:
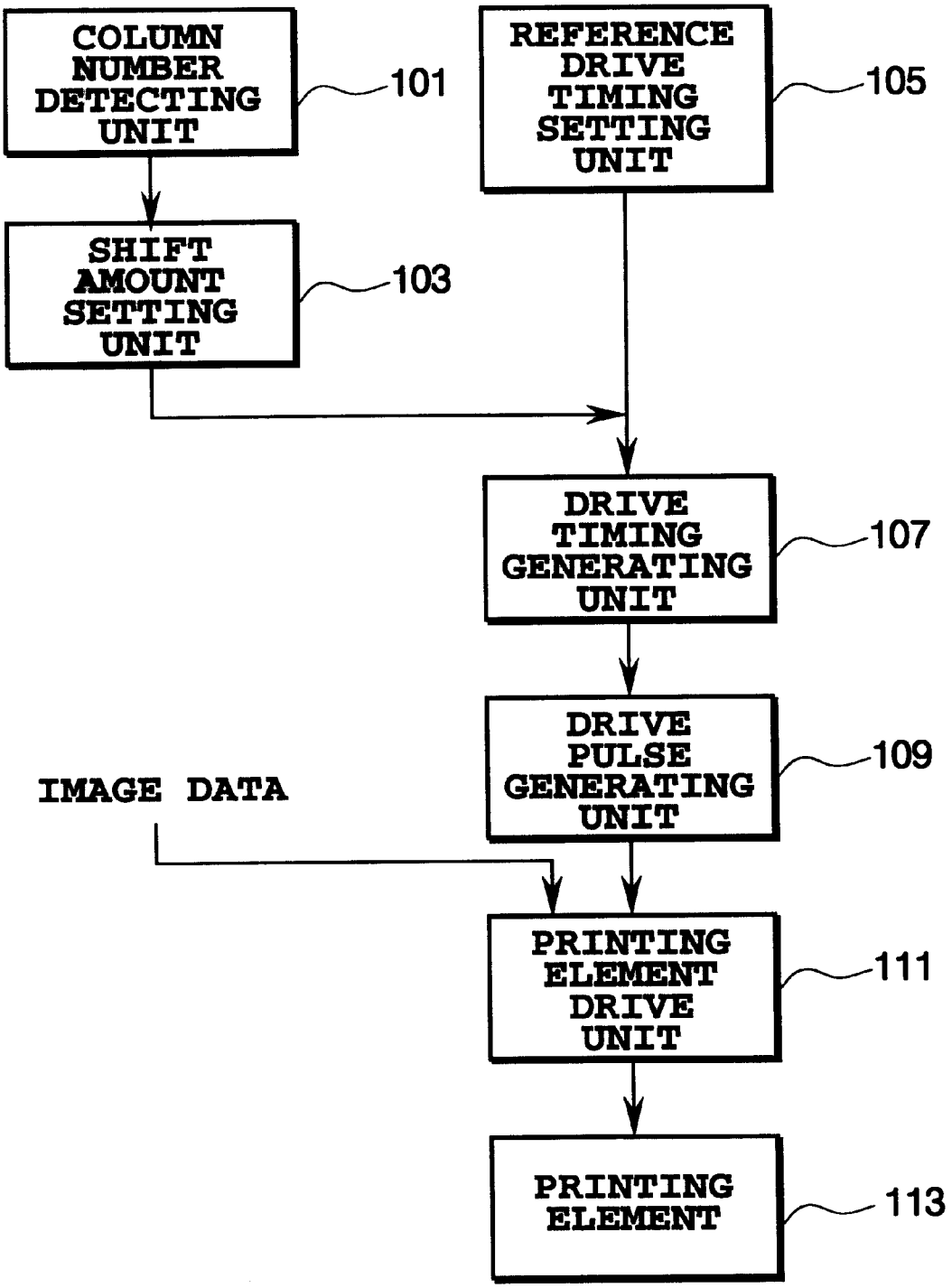
FIG. 9 is a block diagram showing, along the flow of processing, constitutional units of a control system for realizing a drive control in the first embodiment.

FIG. 9 is a block diagram showing the flow of processing performed by units of a control system that realizes the driving method explained above.

In the figure, designated 101 is a column number detecting unit. In a printer of serial scan type such as shown in FIG. 2, if the shift amounts of the same column in successive scans performed by the print head are not equal, a joint portion between an image section formed by a scan and another image section formed by the next scan becomes conspicuous. To deal with this problem, the column number detecting unit 101 forms means for assigning the same column number to those columns in different scans that correspond to the same print head position. An example configuration of such a means may incorporate a counter in the device of FIG. 2 which generates cyclically (j=4) a series of numbers (0–3 in this example) for successive positions in the main scan direction with respect to a predetermined reference position (home position) of the carriage or print head.

Reference numeral 103 denotes a shift amount setting unit, which performs calculations as defined by equation (5) according to the output from the column number detecting unit 101 as a column number identification means and then sets the drive timing interval of the same printing element.

A reference drive timing setting means 105 is a circuit to set the reference drive timing cycle $T_{op}$ determined by the equation (2). A drive timing generating unit 107 combines the reference drive timing with the output from the shift amount setting unit 103, i.e., performs calculation on the equation (3), to set the drive timings for the printing elements. Then a drive pulse generating unit 109 generates a drive pulse.

A printing element drive unit 111 has a circuit as shown in FIG. 5 and is energized at intervals $T_{op}$ determined by the drive pulse generating unit 109 to drive the printing elements 113 (#1–#8) at timings of FIG. 6 in that one interval according to the image data.

Because the above driving procedure causes the distance between adjacent dots in the main scan direction to change at a high spatial frequency, i.e., in a short period (every four dots in this example), visually conspicuous, cyclic variations in the dot-to-dot distance resulting from variations in the manufacturing errors of a rotary drive source such as a pulse motor and of a motor driver that controls it can be eliminated.

Although the configuration of FIG. 9 can be realized by hardware using logic and arithmetic devices, at least a part of this configuration may be realized by software. In that case, by storing a program specifying a sequence of processing and fixed data such as a required pattern in a ROM in a control system generally provided in the printer, the CPU can execute the specified sequence of processing.

Figure 10:
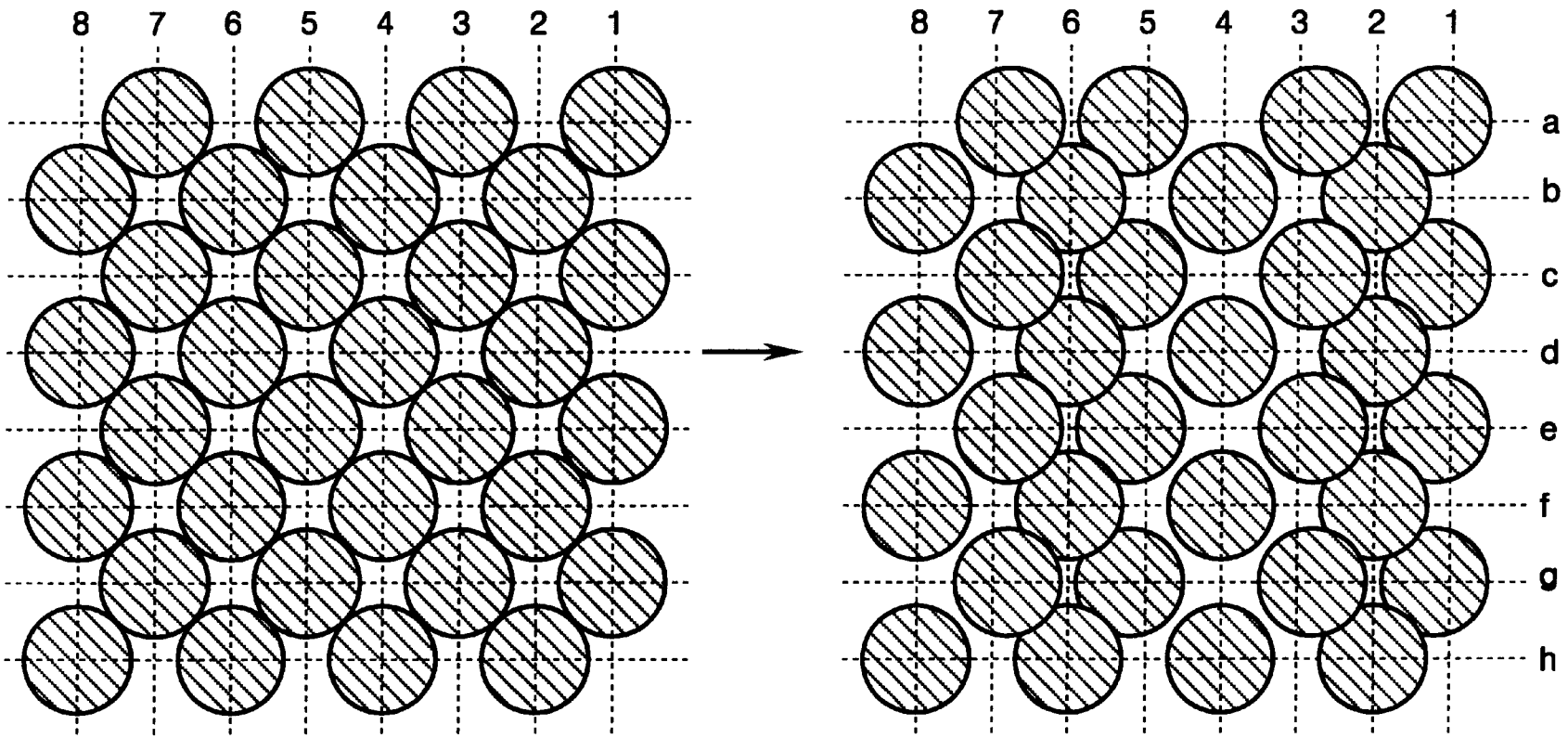
FIG. 10 shows the positional relation between print data and the printed dots in the first embodiment.

FIG. 10 illustrates a printed image (the right half of the drawing) on a printing medium by shifting image information (the left half of the drawing) on printing by the drive method described above.

Figure 4:
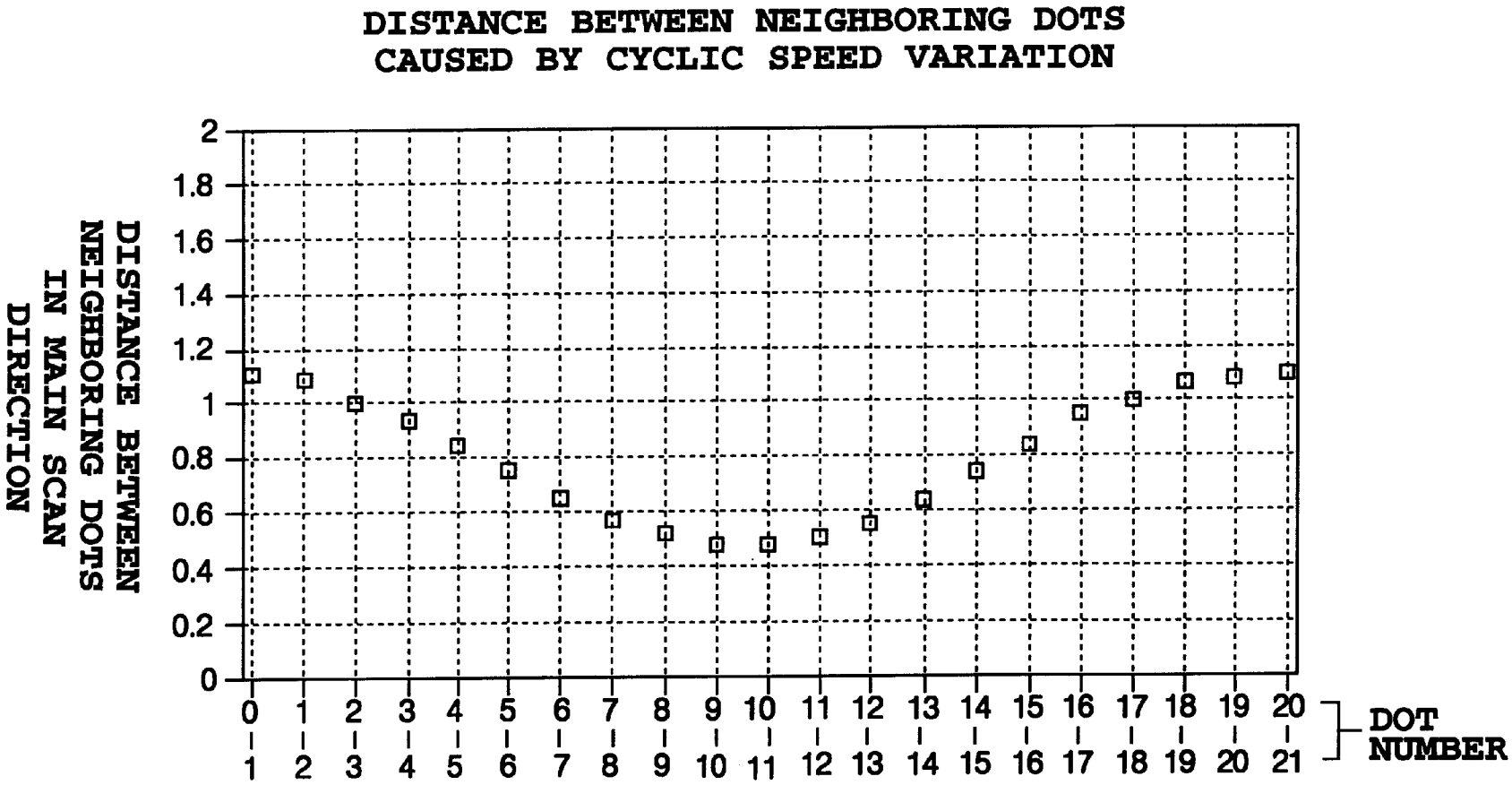
FIG.4 PRIOR ART
FIG. 4 shows variations in the distance between adjacent dots formed during the main scan printing, caused by cyclic feed pitch variations of the carriage in the main scan direction.
Figure 11:
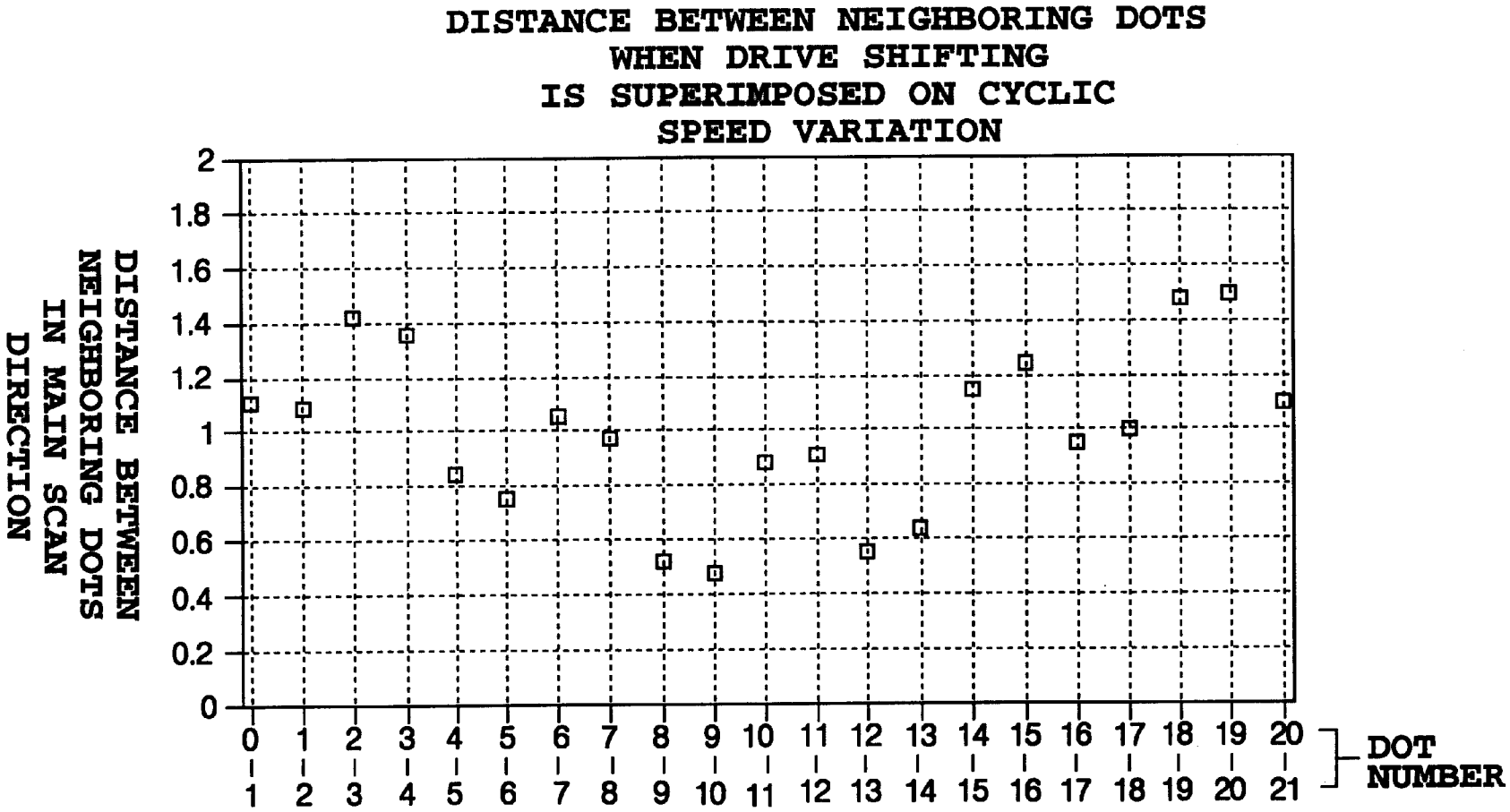
FIG. 11 shows distances between adjacent dots formed during the main scan printing, obtained when high frequency deviations are superimposed on cyclic speed pitch variations of the carriage in the main scan direction.

FIG. 11 shows the distances between adjoining dots printed by this drive method. If the image information shown to the left in FIG. 10 is printed by the conventional drive method, cyclic variations like the ones of FIG. 4 show conspicuously.

Figure 3:
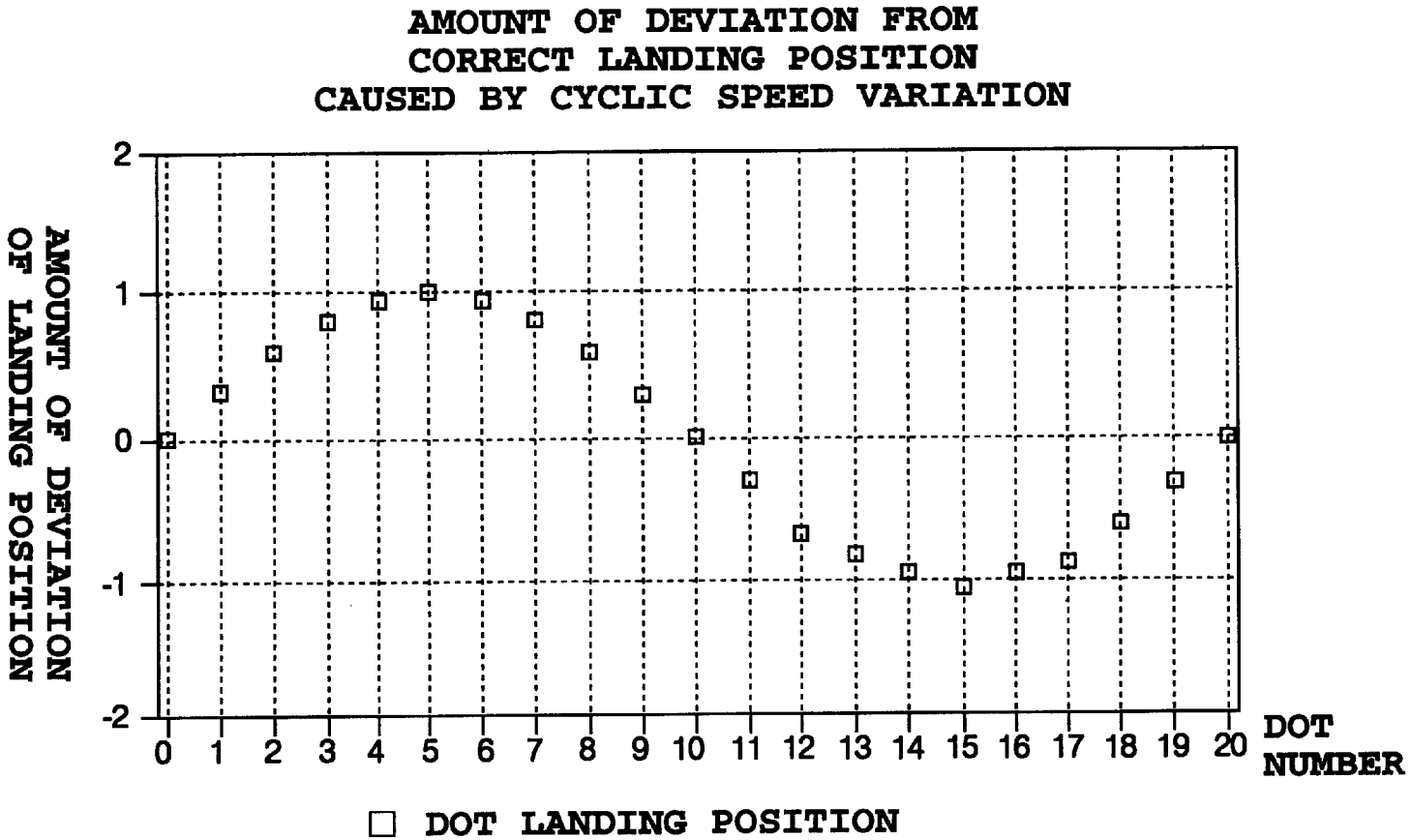
FIG.3 PRIOR ART
FIG. 3 shows deviations of landing positions of ink dots formed during the main scan printing, caused by cyclic feed pitch variations of the carriage in the main scan direction.

Performing the drive timing shift as shown in FIG. 8, i.e., superimposing the drive timing shift of FIG. 8 on the cyclic variations of FIG. 3, results in the magnitudes of distances between adjoining printed dots being scattered as shown in FIG. 11.

This embodiment is based upon observation of the fact that visual perceptibility of unevenness correlates with a distribution state of a distance between adjoining or neighboring dots. More specifically, such unevenness is easily visually perceptible when the distribution state is as illustrated in FIG. 4. In view of this face, a dot shift is carried out in a shorter period as illustrated in FIG. 8, since unevenness is less perceivable visually than in a dot period illustrated in FIG. 4. As illustrated in FIG. 11, a harmonic noise is superimposed on the unevenness of a low frequency wave. From the visual standpoint, such sense of a noise results in relative reduction of the perceptibility of the unevenness of a low frequency wave. More specifically, if unevenness in the cases of a period of four dots or less is hardly visually perceived, it is suitable to create the periodic distribution of neighboring dots limited to among four dots or less, while creating no periodic distribution other than among four dots or less. In this embodiment, the dot shift is carried out in a period of four dots. However, it is also possible to set an appropriate period in which unevenness becomes visually unperceived.

In the ink jet printing, when a printing medium having a liquid absorbing property, such as paper, is printed, the printing medium may form undulations called cockling, which in turn causes tonal variations. Such variations can also be eliminated as effectively by this invention.

Second Embodiment

Next, a second embodiment to eliminate cyclic variations will be explained.

From the above description it is understood that a sufficient correction effect is obtained for variations in the distance between adjoining dots in the main scan direction by introducing a shift whose magnitude is at most one-half the pixel. In this embodiment, print data with a resolution having an area factor of 100% is converted to data with resolution for example, twice as much as the original resolution. For this purpose, the original print data is divided into groups of two columns, with data of a first one of the two columns of original data taken as new first column data, data of a second one of the two columns of the original data as new fourth column data, and data of new second and third columns as null. The image data generated by this process is printed in the main scan direction at a drive timing that will provide a resolution two times the original resolution.

The above process is explained by using equations. For the data of n-th column D(n) (n is an integer 1 or higher) of the above original print image data, print image data D'(n') that has two times the original resolution in the main scan direction is generated by making the following settings.

$$D'(4k-3)=D(2k-1)$$

$$D'(4k-2)=\text{null}$$

$$D'(4k-1)=\text{null}$$

$$D'(4k)=D(2k)\ (k \text{ is an integer not less than } 1)$$

or $$D'(4k-3)=\text{null}$$

$$D'(4k-2)=D(2k-1)$$

$$D'(4k-1)=D(2k)$$

$$D'(4k)=\text{null}$$

Using dots of the above image data having an area factor of 100% in the original resolution, printing is performed at a drive timing that offers two times the original resolution in the main scan direction. The image printed in this way has cyclic variations rendered impossible to recognize visually.

While this embodiment produces two times the original resolution, it is possible to offer n times the original resolution. This is not detailed as it is easily understood from the above description.

Third Embodiment

Figure 12:
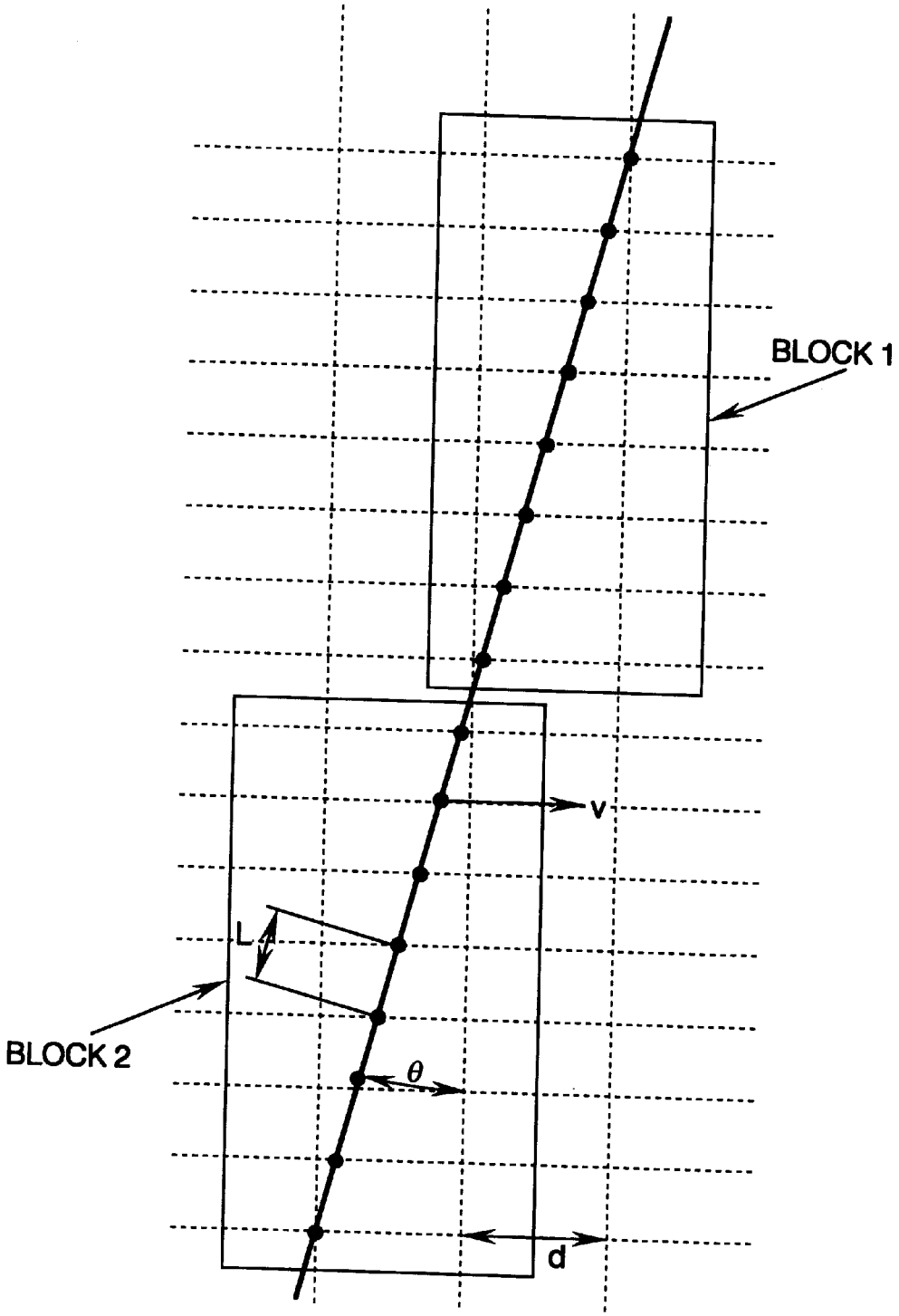
FIG. 12 shows the relation between a print dot coordinate system and the printing elements in the third embodiment of this invention.

Still another embodiment of this invention will be described by referring to FIG. 12.

This embodiment applies the invention to a case where a print head has a greater number of printing elements arranged in a line longer than in the first embodiment so that printing is performed over two times the length of the column of the first embodiment. In this case, if the drive timing intervals for a series of driving pulses are controlled in the same way as the first embodiment in performing the printing, because a group of dots printed by a block 1 and another group of dots printed by a block 2 are virtually not on the same straight line in the sub-scan direction, visually noticeable dot density variations between the block 1 and the block 2 appear in the main scan direction.

To cope with this problem, the block 1 and the block 2 are driven at drive timings independent of each other, driving the block 1 at the same timing as in the first embodiment and the block 2 at a timing lagging the block 1 by one cycle.

Figure 13:
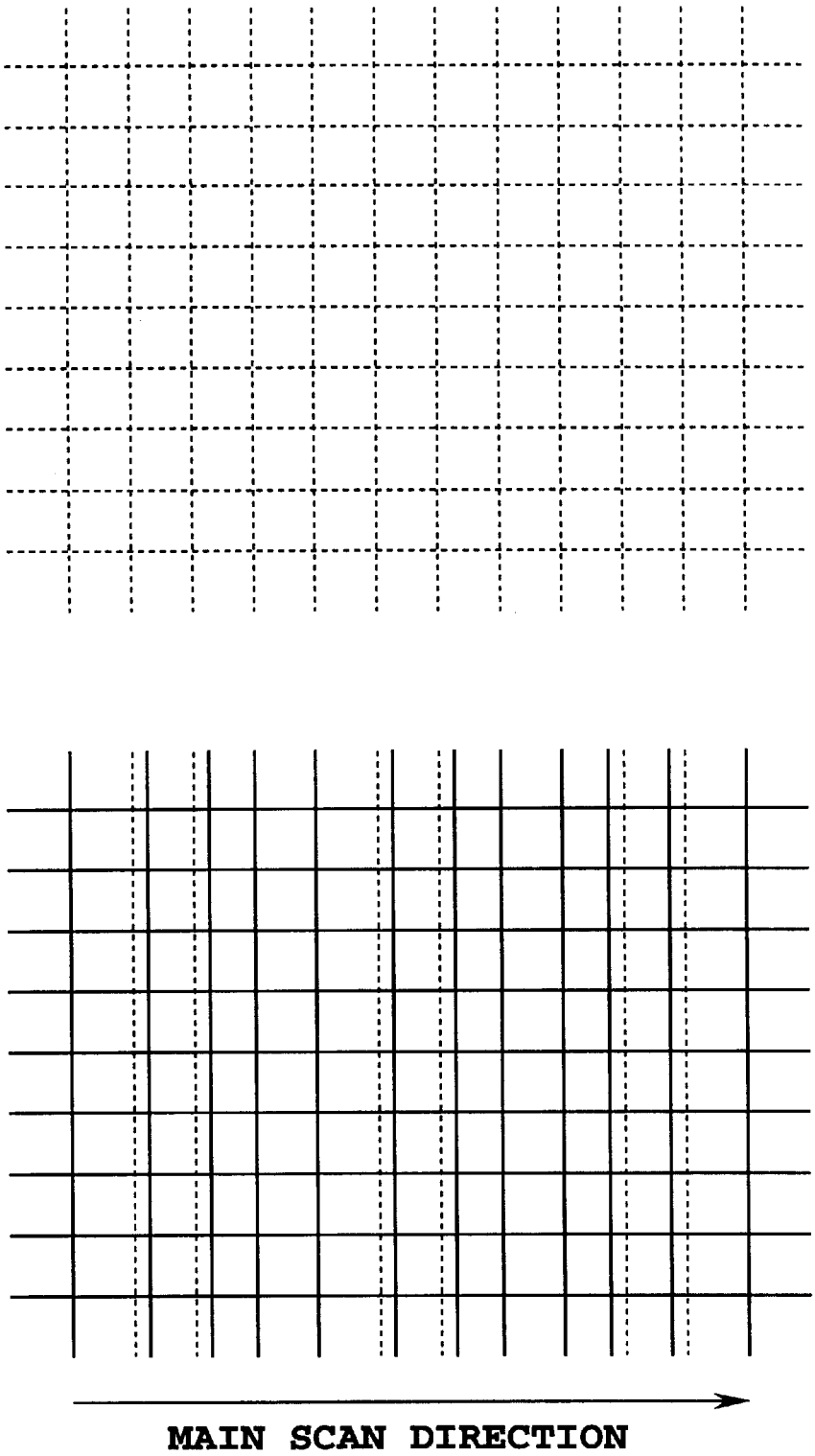
FIG. 13 shows the relation between the print dot coordinate system and a virtual print dot coordinate system for setting a drive timing in the third embodiment.

FIG. 13 shows the timing at which the printing elements are driven. In the upper or lower half of FIG. 13, grid intersections between dotted lines or between dotted lines and solid lines represent dot positions according to the print data. The grid intersections between the solid lines in the lower half of FIG. 13 constitute a virtual coordinate system on the printing medium used to drive the printing elements. The printing elements can be driven with a timing when the printing elements overlap predetermined coordinates with this coordinate system.

The dot positional deviations between the two blocks in the same column can be eliminated in this way. Further, because the distance between adjoining dots in the main scan direction is made to change in a short cycle, cyclic variations in the distance between adjoining dots can be rendered visually unrecognizable.

When a long print head extending three or more times as long as the column of the first embodiment is to be driven, the dot positional deviations can be eliminated similarly by successively shifting the block drive timings.

Further Description

It is readily understood that the present invention can be effectively applied, without regard to the printing method or type of printer, to a printing apparatus in which cyclic variations can occur in the shade level of a printed image due to variations in manufacturing errors of a rotary drive source such as a motor and of a motor driver that controls it and due to other causes.

The present invention achieves a distinct effect when applied to a recording or print head or a recording or print apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

As described above, this invention shifts the positions of dots formed by the printing elements while varying the amount of shift in a short cycle to eliminate visually conspicuous density variations that occur particularly when printing gray scale print data, including variations in a printed image that appear cyclically due to variations in manufacturing errors of a rotary drive source and a motor driver that controls it, and variations caused by undulations of a printing medium such as cockling.

What is claimed is:

1. A print apparatus for forming an image on a printing medium by scanning a print head over a printing medium in a predetermined direction, the print head having a printing element to form print dots, said apparatus comprising:

drive means for driving the printing element to form dots; and timing means for shifting a first timing in a predetermined cycle thereby generating a second timing, the first timing being a reference timing for driving the printing element during a scanning, wherein the printing element is driven in accordance with the second timing.

2. A print apparatus according to claim 1, wherein said timing means shifts the first timing by an amount less than a cycle in which a printed image variation occurs in the predetermined direction during the scanning if the first timing is not changed.

3. A print apparatus according to claim 2, wherein the print head has a plurality of the printing elements aligned in a direction different from the predetermined direction.

4. A print apparatus according to claim 3, wherein said print head is in the form of an ink jet head for ejecting ink from ejecting openings to perform printing.

5. A print apparatus according to claim 4, wherein said print head has thermal energy generating elements for generating thermal energy to be utilized for ejecting ink from said ejecting openings.

6. A print apparatus according to claim 1, wherein said timing means changes a cycle for serially changing a distance between adjoining dots formed in the predetermined direction by the printing element being driven in accordance with the second timing by an amount less than a cycle for serially changing a distance between adjoining dots formed in the predetermined direction by the printing element being driven in accordance with the first timing.

7. A print apparatus for forming an image on a printing medium by scanning a print head over a printing medium in a predetermined direction, the print head having a printing element to form print dots, said apparatus comprising:

drive means for driving the printing element to form the dots in accordance with timings when the positions of the printing element in the predetermined direction coincide with dot coordinate grids of an image to be printed; and timing means for shifting a first timing in a predetermined cycle thereby generating a second timing, the first timing being a reference timing for driving the printing element during a scanning, wherein the printing element is driven in accordance with the second timing.

8. A print apparatus according to claim 7, wherein said timing means shifts the first timing by an amount less than a cycle in which a printed image variation occurs in the predetermined direction during the scanning if the first timing is not changed.

9. A print apparatus according to claim 8, wherein the print head has a plurality of the printing elements aligned in a direction different from the predetermined direction.

10. A print apparatus according to claim 9, wherein said print head is in the form of an ink jet head for ejecting ink from ejecting openings to perform printing.

11. A print apparatus according to claim 10, wherein said print head has thermal energy generating elements for generating thermal energy to be utilized for ejecting ink from said ejecting openings.

12. A print apparatus according to claim 7, wherein said timing means changes a cycle for serially changing a distance between adjoining dots formed in the predetermined direction by the printing element being driven in accordance with the second timing by an amount less than a cycle for serially changing a distance between adjoining dots formed in the predetermined direction by the printing element being driven in accordance with the first timing.

13. A print apparatus for forming an image on a printing medium by scanning a print head over a printing medium in a predetermined direction, the print head having a printing element to form print dots, said apparatus comprising:

drive means for driving the printing element to form dots; and timing means for shifting a first timing in a predetermined cycle thereby generating a second timing, the first timing being a reference timing for driving the printing element during the scanning, said timing means shifting the first timing by an amount less than a cycle in which a printed image variation occurs in the predetermined direction during the scanning if the first timing is not changed, wherein the printing element is driven in accordance with the second timing.

14. A print apparatus for forming an image on a printing medium by scanning a print head over a printing medium in a predetermined direction, the print head having a printing element to form print dots, said apparatus comprising:

drive means for driving the printing element to form the dots in accordance with timings when the positions of the printing element in the predetermined direction coincide with dot coordinate grids of an image to be printed; and timing means for shifting a first timing in a predetermined cycle thereby generating a second timing, the first timing being a reference timing for driving the printing element during a scanning, said timing means shifting the first timing by an amount less than a cycle in which a printed image variation occurs in the predetermined direction during the scanning if the first timing is not changed, wherein the printing element is driven in accordance with the second timing.

15. A print method for forming an image on a printing medium by scanning a print head over the printing medium in a predetermined direction, the Printing head having a printing element for forming print dots, said method comprising the steps of:

shifting a first timing in a predetermined cycle thereby generating a second timing, the first timing being a reference timing for driving the printing element during a scanning; and driving the printing element in accordance with the second timing.

16. A print method according to claim 15, wherein the first timing is shifted by an amount less than a cycle in which a printed image variation occurs in the predetermined direction during the scanning if the first timing is not changed.

17. A print method according to claim 16, wherein the print head has a plurality of printing elements aligned in a direction different from the predetermined direction.

18. A print method according to claim 17, wherein the print head is in the form of an ink jet head for ejecting ink from ejecting openings to perform printing.

19. A print method according to claim 18, wherein the print head has thermal energy generating elements for generating thermal energy to be utilized for ejecting ink from the ejecting openings.

20. A print method according to claim 15, wherein a cycle for serially changing a distance between adjoining dots formed in the predetermined direction by the printing element being driven in accordance with the second timing is changed by an amount less than a cycle for serially changing a distance between adjoining dots formed in the predetermined direction by the printing element being driven in accordance with the first timing.

21. A print method for forming an image on a printing medium by scanning a print head over the printing medium in a predetermined direction, the printing head having a printing element for forming print dots, said method comprising the steps of:

shifting a first timing in a predetermined cycle thereby generating a second timing, the first timing being a reference timing corresponding to a timing when a position of the printing element in the predetermined direction coincides with a dot coordinate grid of an image to be printed and for driving the printing element during the scanning; and driving the printing element in accordance with the second timing.

22. A print method according to claim 21, wherein the first timing is shifted by an amount less than a cycle in which a printed image variation occurs in the predetermined direction during the scanning if the first timing is not changed.

23. A print method according to claim 22, wherein the print head has a plurality of the printing elements aligned in a direction different from the predetermined direction.

24. A print method according to claim 23, wherein the print head is in the form of an ink jet head for ejecting ink from ejecting openings to perform printing.

25. A print method according to claim 24, wherein the print head has thermal energy generating elements for generating thermal energy to be utilized for ejecting ink from the ejecting openings.

26. A print method according to claim 21, wherein a cycle for serially changing a distance between adjoining dots formed in the predetermined direction by the printing element being driven in accordance with the second timing is changed by an amount less than a cycle for serially changing a distance between adjoining dots formed in the predetermined direction by the printing element being driven in accordance with the first timing.

27. A print method for forming an image on a printing medium by scanning a print head over the printing medium in a predetermined direction, the printing head having a printing element for forming print dots, said method comprising the steps of:

shifting a first timing in a predetermined cycle thereby generating a second timing, the first timing being a reference timing for driving the printing element during a scanning, wherein the first timing is shifted by an amount less than a cycle in which a printed image variation occurs in the predetermined direction during the scanning if the first timing is not changed; and driving the printing element in accordance with the second timing.

28. A print method for forming an image on a printing medium by scanning a print head over the printing medium in a predetermined direction, the printing head having a printing element for forming print dots, said method comprising the steps of:

shifting a first timing in a predetermined cycle thereby generating a second timing, the first timing being a reference timing corresponding to a timing when a position of the printing element in the predetermined direction coincides with a dot coordinate grid of an image to be printed and for driving the printing element during the scanning, the first timing being shifted by an amount smaller than a cycle in which a printed image variation occurs in the predetermined direction during the scanning if the drive timings are not changed; and driving the printing element in accordance with the second timing.

* * * * *

UNITED STATES PATENT AND TRADEMARK OFFICE

CERTIFICATE OF CORRECTION

PATENT NO. : 6,142,598
DATED : November 7, 2000
INVENTOR(S) : Hidehiko Kanda et al.

It is certified that error appears in the above-identified patent and that said Letters Patent is hereby corrected as shown below:

Column 1,
Line 47, "26" (second occurrence) should be deleted.

Column 4,
Line 38, "a" should read -- an --.

Column 5,
Line 26, "f (3) =1.0xd/Y (where f (n+4) =f(n) ) tm (5)" should read -- f (3) =1.0xd/Y ¶ (where f (n+4) =f(n) ) (5) --.

Column 6,
Line 35, "face," should read -- fact --; and
Line 65, "resolution" should read -- resolution, --.

Column 9,
Line 5, "consists" should read -- consist --.

Column 11,
Line 65, "Printing" should read -- printing --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*